US005361516A

United States Patent [19]

Dahman

[11] Patent Number: 5,361,516

[45] Date of Patent: Nov. 8, 1994

[54] DEVICE AND METHOD FOR DRYING PANTS WRINKLE-FREE

[76] Inventor: John A. Dahman, 7309 Reading Rd., Cincinnati, Ohio 45237

[21] Appl. No.: 36,189

[22] Filed: Mar. 23, 1993

[51] Int. Cl.[5] ..... F26B 7/00

[52] U.S. Cl. ..... 34/440; 34/437; 34/104; 34/106; 223/73; 223/74

[58] Field of Search ..... 34/103, 104, 105, 106, 34/90, 91, 21, 440, 437, 441; 223/72, 73, 74, 67, 70, 57

[56] References Cited

U.S. PATENT DOCUMENTS

| | | | |
|---|---|---|---|
| 85,059 | 12/1868 | Braun | 34/103 |
| 249,439 | 11/1881 | Wolf | 34/103 |
| 786,554 | 4/1905 | Earl et al. | 34/103 |
| 1,450,033 | 3/1923 | Gowan . | |
| 3,021,606 | 2/1962 | Carpenter et al. | 34/103 |
| 3,263,877 | 8/1966 | Radford | 223/73 |
| 3,298,578 | 1/1967 | Shields | 223/67 |
| 3,433,396 | 3/1969 | Swartz | 223/73 |
| 3,892,047 | 7/1975 | Müller-Scherak | 34/103 |
| 4,085,519 | 4/1978 | Masika | 34/104 |
| 4,303,183 | 12/1981 | Schlemon | 223/67 |
| 4,475,673 | 10/1984 | Ochiai | 223/70 |

FOREIGN PATENT DOCUMENTS

| | | | |
|---|---|---|---|
| 48610 | 10/1986 | Germany | 34/103 |

*Primary Examiner*—Denise L. Gromada
*Attorney, Agent, or Firm*—Ronald W. Kock

[57] ABSTRACT

Device and method for drying pants wrinkle-free by closing the waist and leg openings of the pants and by blowing pressurized air into the pants through an opening in an impermeable member which supports the waist of the pants. Pressurized air inside the pants simultaneously stretches the pants free of wrinkles and causes air to flow through the permeable pants to carry away moisture. A portable hair dryer preferably generates a static pressure of from 0.1 inches (2.5 mm) of water to 0.3 inches (7.6 mm) of water in order to stretch wrinkles from the pants without overly stretching any part of them. The impermeable member supporting the pants is preferably an adjustable disk assembly capable of fitting a large size range of pants, which is hung from a clothes line by a cord with a hook.

10 Claims, 3 Drawing Sheets

DEVICE AND METHOD FOR DRYING PANTS WRINKLE-FREE

FIELD OF THE INVENTION

The present invention relates to garment finishing, and more particularly to drying pants in a substantially wrinkle-free manner. Even more particularly the present invention relates to a device and method for drying pants using air to simultaneously stretch the fabric and carry moisture away.

BACKGROUND OF THE INVENTION

Heavy cotton pants and jeans have become popular casual wear. Wrinkles are common when such pants are laundered and dried, whether they are hung from a clothes line or they are tumble-dried by machine. The manual step of hand-ironing normally follows drying in order to press out the undesirable wrinkles.

Commercial laundries have long had equipment to stretch garments while drying them in order to prevent wrinkles from forming in the first place. For example, U.S. Pat. No. 3,263,877 to Radford, U.S. Pat. No. 3,433,396 to Swartz, U.S. Pat. No. 3,892,047 to Muller-Scherak, U.S. Pat. No. 4,303,183 to Schlemon and U.S. Pat. No. 4,475,673 to Ochiai all disclose drying processes having gas-permeable, tubular or torso-shaped bags mounted inside garments to be dried. Pressurized air is used to inflate the bags in order to stretch wrinkles from damp garments draped over them. Bags are permeable in order to permit air to flow through both the bags and the garments in order to dry them. The bags act principally to control the air flow so that bag inflation is achieved regardless of garment permeability or openings in the garments draped over the bags.

Similar to commercial systems, U.S. Pat. No. 3,298,578 to Shields discloses a foldable, torso-shaped, perforated hanging bag, which may be useful in the home for garment drying when the user supplies an air source. The primary benefit of such a system is the elimination of the need for post-drying operations, such as hand ironing, for removing wrinkles.

What has been lacking in the garment finishing art is a simple process, and an inexpensive, portable device specifically designed for individuals to dry their pants in a substantially wrinkle-free manner, at home or wherever they may travel. It is an object of the present invention to stretch and dry pants of the jeans and heavy cotton type by simultaneously inflating and passing air through them without the need for a bag or other stretching device. It is another object of the present invention to fit a drying device to any pant waist size with a simple adjustment. With this portable invention, individuals may dry pants substantially wrinkle-free anywhere they desire, as long as they can provide a source of pressurized air, and a support for the device.

SUMMARY OF THE INVENTION

In practicing the present invention a user may support their dampened pants on a device that also fills the waist opening so that air pressure may be generated inside the pants with minimum leakage through large openings. The user may then close the leg holes of the pants, preferably with resilient C-shaped clamps individually attachable to each flattened pant leg adjacent the leg opening. After hanging the device to a hook or clothes line, the user may attach a portable hair dryer to the device, preferably by friction fit into a hole in the device. When the hair dryer is operated, preferably with heat, air is blown with sufficient static pressure to inflate the dampened pants in order to stretch out the wrinkles. At the same time some air from the hair dryer will also flow through the permeable fabric of the pants body and legs, thereby carrying away moisture and drying the pants.

In one preferred embodiment of the present invention the device for suspending damp pants to be dried comprises an impermeable member adapted to fit inside the pants waist opening and suspend the pants from the waist. The impermeable member has at least one opening communicating with the inside of the pants adapted to receive a source of pressurized air from outside the pants. At least one hangar member is connected to the impermeable member for supporting it.

More preferably, the device for suspending damp pants to be dried comprises a disk adapted to fit inside the pants body. The waist opening typically has a smaller perimeter than the body so that the disk may be slightly larger than the waist opening. Since the disk fits inside the pants body the waist is prevented from slipping over the disk when the pants are freely suspended.

Even more preferably, the impermeable member is a disk assembly comprising a first flat portion and a second flat portion. The first flat portion has at least one threaded fastener extending from it, and the second flat portion has at least one slot adapted to receive each such threaded fastener. The flat portions of the disk assembly are slidable against each other within the limits of the slots so that the disk assembly may be adjusted to fill different size waist openings. Each fastener has a means connected to it, such as a wingnut, for clamping the second flat portion against the first flat portion in order to maintain the adjustment which has been set.

The source of pressurized air which both stretches and dries the pants need not be heated. Heat does speed up drying, however, and is preferred. A single portable hair dryer is the preferred source of pressurized air. It is generally capable of maintaining a static air pressure inside the pants of from 0.1 inches (2.5 mm) of water to 0.3 inches (7.6 mm) of water in order to stretch wrinkles from the pants, but without overly stretching any part of the pants. The preferred portable hair dryer has a housing with a cross-section which attaches to the impermeable member by friction fit in the opening that communicates with the inside of the pants. A requirement of the preferred disk assembly is that it be adjusted without creating any opening other than the one filled by the source of pressurized air.

At least one flexible hangar member is part of the device which supports the pants for drying. The preferable flexible hangar member is a single cord tied to the impermeable member at two places. The cord has a hook-shaped member, preferably connected near its center, which can slip over a clothes line or a hook on the back of a door, for example, in order to permit pants to be freely suspended.

The preferred method for drying damp pants comprises the steps of filling the waist opening of the pants with an impermeable member having an opening communicating with the inside of the pants, the opening being adapted to receive a pressurized source of air from outside the pants; closing the leg openings of the pants; supporting the impermeable member having pants hanging therefrom; and blowing pressurized air continuously into the pants through the opening in the impermeable member, such that the air has sufficient pressure to simultaneously expand the parts to stretch out wrinkles and to drive air through the permeable pants body and legs to dry them substantially wrinkle-free.

More specifically the method further comprises the steps of inserting the impermeable member into the waist opening and then adjusting it to fit, flattening each of the permeable legs adjacent to the leg openings in order to close the leg openings, sliding a resilient C-shaped member over each of the flattened legs adjacent to the leg openings to hold them closed, and heating the pressurized air as it is blown into the pants.

DETAILED DESCRIPTION OF THE INVENTION

Figure 1:
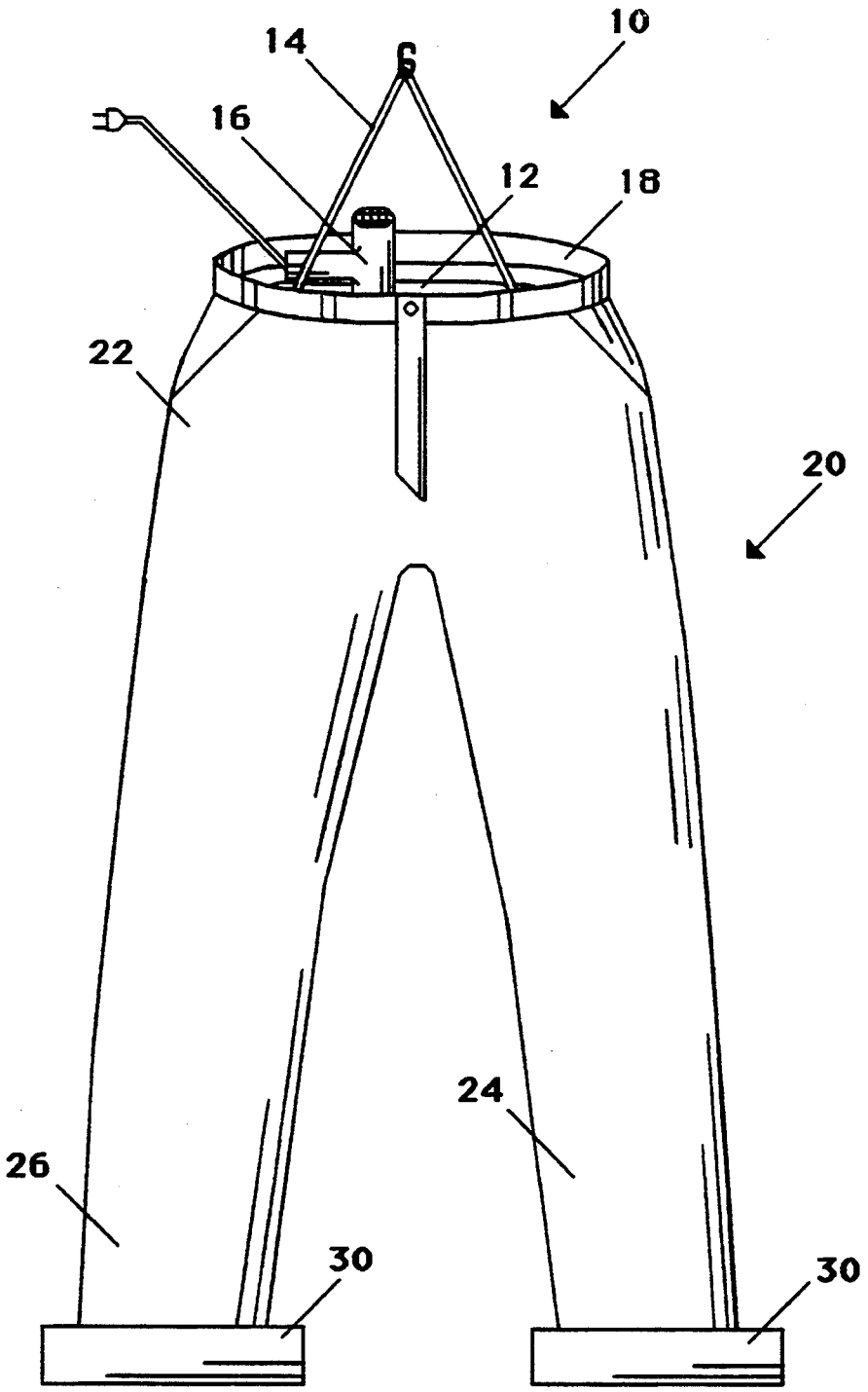
FIG. 1 is a perspective front elevation view of a pair of pants, disclosing a preferred embodiment of the present invention installed for pants drying.

Referring now to the drawings, and more particularly to FIG. 1, there is shown a first preferred embodiment of the present invention, generally indicated as 10. Device 10 is an impermeable member 12 having a flexible hangar 14 and a source of pressurized air 16. Impermeable member 12 is slightly larger than a waist opening 18 of a pair of pants 20 such that when placed inside the body 22 of pants 20, impermeable member 12 freely suspends pants 20 from the waist opening 18. The source of pressurized air 16 blows air into the pants to cause them to expand and stretch out wrinkles while some of the air permeates the pants to carry away moisture and dry the pants. In order for the source of pressurized air 16 to maintain static pressure inside the pants 20, all major openings of the pants must first be closed. Thus, pants legs 24 and 26 have leg openings, not shown, which are each closed by a resilient C-shaped clamp 30.

Figure 2:
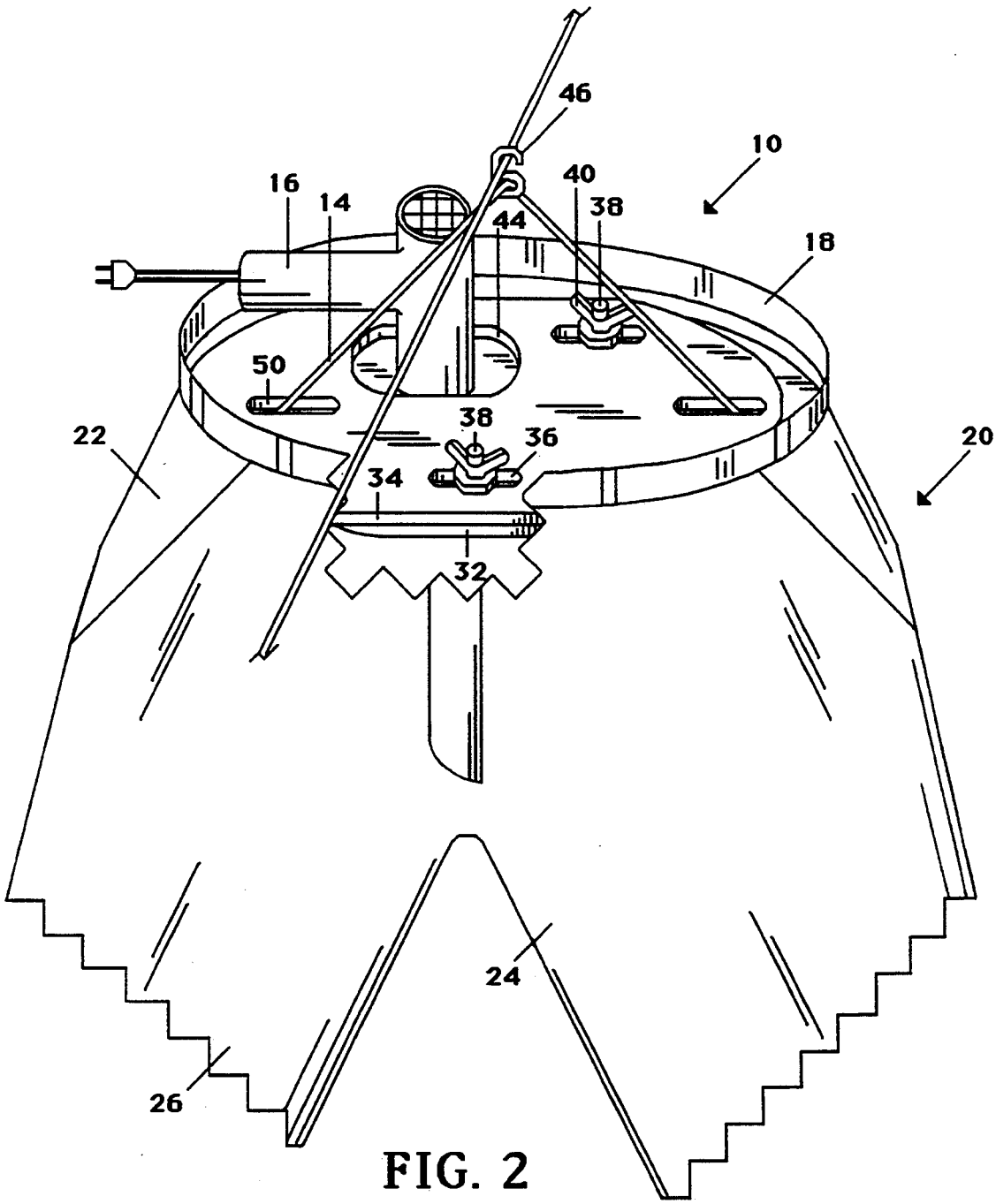
FIG. 2 is an enlarged perspective front elevation view disclosing the upper portion of the pair of pants of FIG. 1, disclosing a portable hair dryer connected to an adjustable disk assembly of the present invention, the disk assembly filling the waist opening of the pants and suspending the pants for drying.
Figure 3:
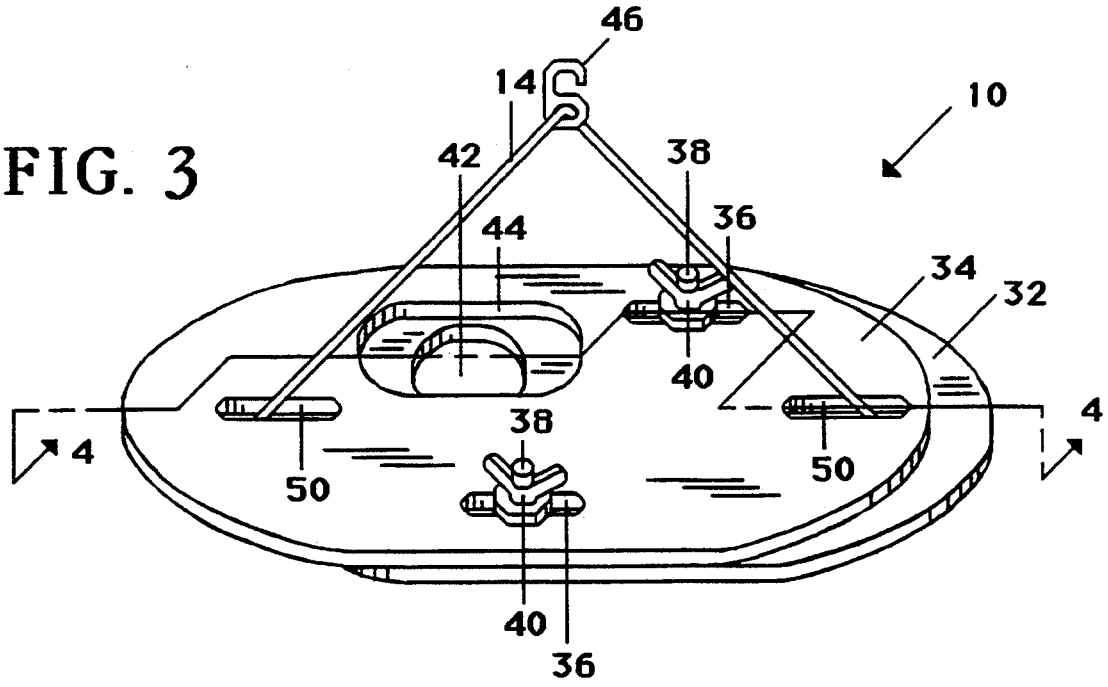
FIG. 3 is a front elevation perspective view of the adjustable disk assembly of the present invention shown in FIG. 2, further disclosing adjustment means and an opening adapted to receive a source of pressurized air.
Figure 4:
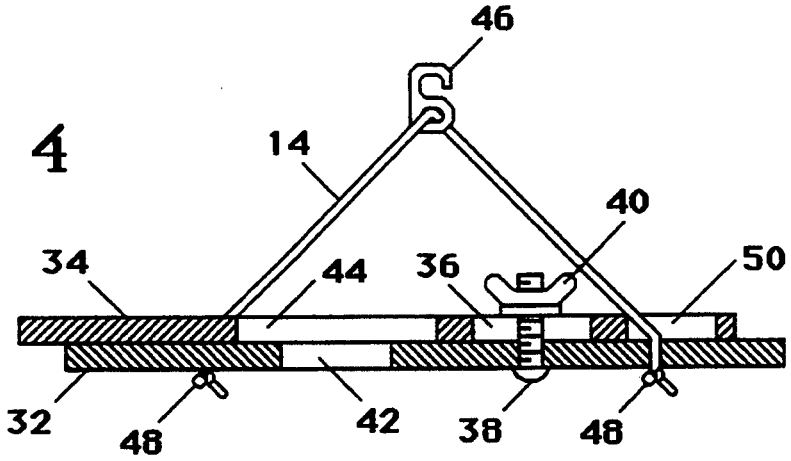
FIG. 4 is a sectioned side elevation view, taken along section line 4—4 of FIG. 3, showing first and second disks of the adjustable disk assembly and the connection of a flexible support cord.

FIGS. 2, 3, and 4 show device 10 more clearly. Impermeable member 12 is preferably an adjustable disk assembly. Alternatively, member 12 could be a solid disk without adjustment, intended for a specific pants size. Member 12 could also be an inflated donut. However, an adjustable disk assembly is preferred because it fits a large size range of pants. Disk assembly 12 has a first disk 32 and a second disk 34. The disk assembly 12 is inserted into the body 22 of pants 20 and then second disk 32 is slidably adjusted relative to first disk 32 to be slightly larger than waist opening 18 so that pants 20 will not slip off disk assembly 12 when suspended therefrom. First disk 32 is shown beneath second disk 34. First disk 32 has preferably two threaded fasteners 38 extending upward toward second disk 34. Fasteners 38 fit tightly in holes through disk 32 in order to keep them from falling out during disk assembly. Second disk 34 has preferably a pair of parallel slots 36 which are aligned to receive threaded fasteners 38. Fasteners 38 loosely fit through disk 34 and extend above it. A wing-nut 40 is threaded onto each fastener 38 and can be tightened against disk 34 to maintain the adjustment of disk assembly 12 inside pants 20.

First disk 32 has an opening 42 communicating with the inside of pants 20. Opening 42 is preferably circular and sized to friction fit the source of pressurized air 16. Second disk 34 has a large slot 44, which has a width greater than the diameter of opening 42. The position and length of slot 44 is adapted to provide the full range of adjustment offered by slots 36. It is key that throughout the full range of adjustment of disk assembly 12, there are no substantial openings created in the disk assembly. That is, the slots of second disk 34 are always overlapped by first disk 32. The shape of first disk 32 and of second disk 34 is preferably rectangular with semicircular ends so that as they slide relative to each other their overall profile remains a smooth shape. This overall shape is denoted herein as oval. Alternative shapes are possible, and different slots or relief notches for slidable adjustment are possible. For example, the opening 42 could be in upper disk 34 if lower disk 32 were relieved to allow opening 42 to maintain communication with the inside of pants 20 throughout the adjustment range. Also, more than one opening 42 could be adapted to receive more than one source of pressurized air 16.

The source of pressurized air 16 is preferably a 110 volt portable hair dryer with a housing adapted to fit snugly in opening 42 by friction fit. FIG. 2 shows hair dryer 16 installed and FIG. 3 shows it removed. Hair dryer 16 preferably blows warm air into pants 20, since warm air dries pants 20 more quickly than ambient air. However, ambient air will dry pants 20 satisfactorily. Hair dryer 16 will typically generate a static pressure inside pants 20 of from 0.1 inches (2.5 mm) of water to 0.3 inches (7.6 mm) of water in order to stretch wrinkles from the pants without overly stretching any part of them. Alternative sources of pressurized air include an axial or centrifugal blower flange-mounted around hole 42, for example by threaded fasteners; and a flexible duct from an automatic clothes dryer vent, flange mounted or friction fit into hole 42.

Impermeable member 12 is preferably supported by a flexible hangar member 14, which has a hook 46 attached, for supporting hangar member 14 from a clothes line or door hook. When hung from a clothes line as shown in FIG. 2, the pants are suspended freely from the waist. In this orientation there are minimal gravitational forces to cause wrinkles in the pants during the drying process other than in the crotch area where they are least noticeable. As seen in FIG. 4, flexible hangar member 14 is preferably a cord with both ends tied in knots 48 at the underside of first disk 32, and extending through clearance holes in disk 32 at opposite ends of disk 32. Second disk 34 preferably has a pair of slots 50 parallel with slots 36 and 44 aligned with cord ends from disk 32. Cord 14 then extends through slots 50 such that while supported by cord 14, disk assembly 12 can be adjusted without interference from the hangar member. A flexible hangar member is preferred for storage compactness, but a rigid hangar member would function adequately. A rigid hangar member could be a large hook at the center of disk 34, extending perpendicular to and threaded into disk 34. Also, at least one ordinary clothes hangar could be clamped to the top surface of disk 34 to serve as a hangar member.

Figure 5:
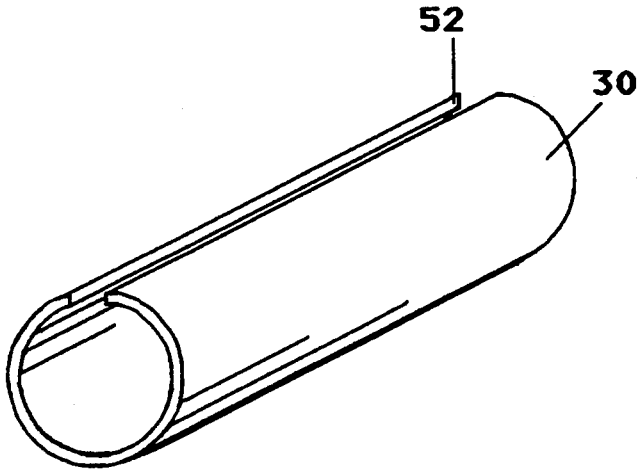
FIG. 5 is a perspective elevation view of a resilient C-shaped clamp of the present invention, disclosing the slot into which a flattened pant leg is placed to close the leg opening.

FIGS. 1 and 5 show a preferred means for closing the leg openings of a pair of pants 20. The preferred means is a resilient C-shaped clamp 30, which is preferably a short length of rigid plastic tubing having a slot 52 cut parallel to the tubing axis for the full length of the tubing. Preferably slot 52 is relieved at its midpoint in order to provide clearance for the thick overlap seams along the length of the pant legs. A clamp 30 is installed, for example, by flattening leg 24 of pants 20, thereby closing the leg opening, and then by slipping resilient clamp 30 over the flattened pants leg from one edge of the flattened leg with the end of the pants leg inside the C-shaped clamp. Alternatively, the ends of pants legs 24 and 26 could be flattened and then folded toward pants body 22. The fold would effectively close the leg opening and could be maintained folded by clothespins or the like. However, leg cuff wrinkles may result by using the folding alternative. Leg closing means may be attached by flexible cord to the impermeable member to prevent their being misplaced; independent C-shaped members may be packaged with the impermeable member; or closing means may be separately provided by the user.

The preferred embodiment of the present invention is made as follows: First disk 32 has a thickness of 0.13 inches (0.32 cm), a width of 7.63 inches (19.37 cm), an overall length of 10.25 inches (26.03 cm), and is made of dense cardboard, wood, metal, plastic, or combinations of them. Second disk 34 is similar in outer dimensions and material as first disk 32. Threaded fasteners 38 are plated steel 5/16"–18 by ¾ inches (1.91 cm) long round head screws, and plated steel wingnuts 40 are also threaded 5/16"–18. Slots 36, 44, and 50 provide a range of adjustment of the disk assembly 12 of approximately 4 inches (10.16 cm). Opening 42 in disk 32 is 2.38 inches (6.03 cm) in diameter. Cord 14 is 12 inches (30.48 cm) long, approximately 0.094 inches (0.24 cm) in diameter, and is made of woven fiber. Resilient C-shaped clamp 30 is 11 inches (27.94 cm) long and has an outer diameter of 2 inches (5.08 cm). The wall thickness of clamp 30 is 0.13 inches (0.32 cm) and it is made of commercial polyvinyl chloride pipe. Portable hair dryer 16 is a model WJRK-2619 made by Consumer Products Division of Gheri Redding Products Company of Phoenix, Ariz. The pants waist size range which the preferred embodiment is intended to fit is 29 inches (73.66 cm) to 37 inches (93.98 cm). Drying a pair of jeans using the preferred embodiment and heated air requires approximately 20 minutes for the body and legs, depending on dampness of the pants to be dried. Damp pant leg cuffs, and waist opening outside the disk assembly, may air dry after the pants are removed from the device.

It is thought that the device and method for drying pants wrinkle-free of the present invention, and many of its attendant advantages, will be understood from the foregoing description; and it will be apparent that various changes may be made in form, construction, and arrangement without departing from the spirit and scope of the invention or sacrificing all of its material advantages, the forms hereinbefore described being merely preferred or exemplary embodiments thereof.

What is claimed is:

1. A device for suspending damp pants to be dried, said pants having all openings closed except for a waist opening, said device comprising:

a) disk assembly adapted to fit inside pants having a body with a waist opening, said waist opening having a smaller perimeter than said body so that said disk assembly may be positioned to fill said waist opening from inside said body to prevent said waist opening slipping over said disk assembly when said pants are freely suspended therefrom, said disk assembly having at least one opening communicating with the inside of said pants, said at least one opening adapted to receive a source of pressurized air from outside said pants for drying said pants; and b) at least one hangar member connected to said disk assembly for supporting said disk assembly, said disk assembly comprising a first flat portion and a second flat portion, said first flat portion having at least one threaded fastener extending therefrom, said second flat portion having at least one slot adapted to receive said at least one threaded fastener, said flat portions slidable against each other within the limits of said at least one slot so that said disk assembly may be adjusted to fill different size waist openings, said at least one fastener having a means connected thereto for clamping said second flat portion against said first flat portion to maintain adjustment.

2. A device for drying damp pants, said device comprising:

a) a disk assembly to fit inside pants having a waist opening and permeable body and legs, each of said legs having a leg opening, said waist opening having a smaller perimeter than said body, said disk assembly comprising adjustment means to fill said waist opening from inside said body in order to prevent said waist opening slipping over said disk assembly when said pants are suspended therefrom, said disk assembly having at least one opening communicating with the inside of said pants, said at least one opening adapted to receive a source of pressurized air from outside said pants;

b) at least one hangar member connected to said disk assembly for supporting said disk assembly;

c) a resilient C-shaped member to close each of said leg openings, said members individually clamping each of said pant legs when each of said pant legs is flattened; and d) a source of pressurized air connected to said at least one opening in said disk assembly to continuously blow air into said pants so that air pressure simultaneously expands said pants to stretch out wrinkles and drives air through said permeable body and legs to dry said pants substantially wrinkle-free.

3. The device of claim 2 wherein said source of pressurized air maintains a static air pressure inside said pants of from 0.1 inches (2.5 mm) of water to 0.3 inches (7.6 mm) of water in order to stretch wrinkles from said pants without overly stretching any part of said pants.

4. The device of claim 2 wherein said source of pressurized air comprises at least one portable hair dryer, said at least one portable hair dryer having a housing with a cross-section which connects by friction fit to said at least one opening in said disk assembly.

5. The device of claim 2 wherein said source of pressurized air heats the air blown into said pants so that said pants may be dried quickly.

6. A device for drying damp pants, said device comprising:

a) a disk assembly adapted to fit inside pants having a waist opening and permeable body and legs, each of said legs having a leg opening, said waist opening having a smaller perimeter than said body so that said disk assembly may be positioned to fill said waist opening from inside said body in order to prevent said waist opening slipping over said disk assembly when said pants suspended therefrom, said disk assembly having at least one opening communicating the inside of said pants, said at least one opening adapted to receive a source of pressurized air from outside said pants, said disk assembly comprising a first flat portion and a second flat portion, said first flat portion having at least one threaded fastener extending therefrom, said second flat portion having at least one slot adapted to receive said at least one threaded fastener, said flat portions slidable against each other within the limits of said at least one slot so that said assembly may be adjusted to fill different size waist openings, said at least one fastener having a means connected thereto for clamping said second flat portion against said first fat portion to maintain adjustment;

b) at least one hangar member connected to said disk assembly for supporting said disk assembly;

c) a resilient C-shaped member to close each of said leg openings, said members individually clamping each of said pant legs when each of said pant legs is flattened; and d) a source of pressurized air connected to said at least one opening in said disk assembly to continuously blow air into said pants so that air pressure simultaneously expands said pants to stretch out wrinkles and drives air through said permeable body and legs to dry said pants substantially wrinkle-free.

7. A method of drying damp pants, said pants having a waist opening and permeable body and legs, each of said legs having a leg opening, said method comprising the steps of:

a) filling said waist opening of pants with an impermeable member, said impermeable member having at least one opening communicating with the inside of said pants, said at least one opening adapted to receive a pressurized source of air from outside said pants;

b) closing said leg openings of said pants;

c) hanging said impermeable member having said pants suspended therefrom; and d) blowing pressurized air continuously into said pants through said at least one opening in said impermeable member, said air having sufficient pressure to simultaneously expand said pants to stretch out wrinkles and drive air through said permeable pants body and legs to dry said pants substantially wrinkle-free.

8. The method of claim 7 further comprising the step of heating said pressurized air as it is blown into said pants.

9. The method of claim 7 wherein the step of closing said leg openings further comprises the steps of:

a) flattening each of said permeable legs adjacent to said leg openings to close said leg openings; and b) sliding a resilient C-shaped member over each of said flattened legs adjacent to said leg openings to hold them closed.

10. The method of claim 7 wherein the step of filling said waist opening further comprises the steps of:

a) inserting said impermeable member into said waist opening; and b) adjusting said impermeable member to fit said waist opening.

* * * * *